US009970682B2

(12) United States Patent
Okada et al.

(10) Patent No.: US 9,970,682 B2
(45) Date of Patent: May 15, 2018

(54) HOT WATER SUPPLY SYSTEM

(71) Applicant: RINNAI CORPORATION, Nagoya-shi, Aichi (JP)

(72) Inventors: Kumiko Okada, Nagoya (JP); Hideki Kitagawa, Nagoya (JP)

(73) Assignee: RINNAI CORPORATION, Nagoya-Shi, Aichi (JP)

( * ) Notice: Subject to any disclaimer, the term of this patent is extended or adjusted under 35 U.S.C. 154(b) by 129 days.

(21) Appl. No.: 14/972,524

(22) Filed: Dec. 17, 2015

(65) Prior Publication Data

US 2016/0178240 A1 Jun. 23, 2016

(30) Foreign Application Priority Data

Dec. 19, 2014 (JP) ..... 2014-257373

(51) Int. Cl.
*F24H 9/20* (2006.01)
*F24H 1/00* (2006.01)

(52) U.S. Cl.
CPC ..... *F24H 9/2035* (2013.01); *F24H 1/0027* (2013.01)

(58) Field of Classification Search
CPC ..... F24H 9/0235; F24H 1/0027
USPC ..... 122/14.2
See application file for complete search history.

(56) References Cited

U.S. PATENT DOCUMENTS 6,109,339 A * 8/2000 Talbert ..... F24D 11/0214 126/101
2012/0090560 A1* 4/2012 Iwama ..... F24H 1/145 122/14.3

FOREIGN PATENT DOCUMENTS

JP 2004-045020 2/2004
JP 2005-172317 6/2005

OTHER PUBLICATIONS

English Abstract of Japanese Patent Application No. JP2005-172317.
Machine Translation prepared by the Japanese Patent Office of Japanese Patent Application No. JP2005-172317.
English Abstract of Japanese Patent Application No. JP2004-045020.
Machine Translation prepared by the Japanese Patent Office of Japanese Patent Application No. JP2004-045020.

* cited by examiner

*Primary Examiner* — Alissa Tompkins
*Assistant Examiner* — John Bargero
(74) *Attorney, Agent, or Firm* — Vierra Magen Marcus LLP

(57) ABSTRACT

A hot water supply system includes: a water heater; a circulating water passage; a water supply passage; and a circulating pump. The water heater is configured to emergently stop if a burner is performing combustion, an air supply fan is operating, the circulating pump is not operating, and a temperature detected by an apparatus interior temperature sensor exceeds an upper limit temperature. The water heater is configured to execute an apparatus interior cooling operation of stopping combustion of the burner, driving the air supply fan, and driving the circulating pump, if the burner is performing combustion, the air supply fan is operating, the circulating pump is operating, and the temperature detected by the apparatus interior temperature sensor exceeds the upper limit temperature.

3 Claims, 5 Drawing Sheets

HOT WATER SUPPLY SYSTEM

CROSS-REFERENCE TO RELATED APPLICATION(S)

This application claims priority to Japanese Patent Application No. 2014-257373 filed on Dec. 19, 2014, the contents of which are hereby incorporated by reference into the present application.

TECHNICAL FIELD

The present application relates to a hot water supply system.

DESCRIPTION OF RELATED ART

JP2005-172317A discloses a water heater including: a housing; a combustion chamber which is housed within the housing; a burner which is housed within the combustion chamber; an air supply fan which sends air within the housing into the interior of the combustion chamber; a first heat exchanger which is housed within the combustion chamber and exchanges heat between combustion gas from the burner and water flowing therethrough; a water supply pipe which is housed within the housing and through which water is supplied to the first heat exchanger; a hot water supply pipe which is housed within the housing and through which hot water is supplied from the first heat exchanger; an air supply pipe through which air is introduced from an outdoor space into the interior of the housing; an exhaust pipe through which exhaust gas is discharged from the interior of the combustion chamber to the outdoor space and at which heat exchange is performed between the air flowing through the air supply pipe and the exhaust gas flowing through the exhaust pipe; a second heat exchanger which is housed within the housing and exchanges heat between the air flowing from the air supply pipe into the interior of the housing and water flowing therethrough; a first bypass pipe which is housed within the housing and through which the water from the water supply pipe is sent to the second heat exchanger; a second bypass pipe which is housed within the housing and through which the water from the second heat exchanger is sent to the hot water supply pipe; and a control device which is housed within the housing. In the water heater, the air flowing from the air supply pipe into the interior of the housing can be cooled by heat exchange with the water flowing through the second heat exchanger. Thus, even when the temperature of the air flowing through the air supply pipe becomes excessively high due to heat exchange with the exhaust gas flowing through the exhaust pipe, it is possible to restrain the temperature of the air within the water heater from being excessively high.

In the water heater described above, for example, when abnormality such as clogging of a fin in the second heat exchanger occurs, the temperature of the air within the housing increases, and the components, such as the control device, housed within the housing are exposed to a high temperature. Thus, preferably, an apparatus interior temperature sensor which detects the temperature of the air within the housing is provided beforehand, and when the temperature detected by the apparatus interior temperature sensor exceeds an upper limit temperature, it is determined that some kind of abnormality has occurred in the water heater, and the water heater is emergently stopped. With such a configuration, it is possible to prevent the components housed within the housing from being exposed to a high temperature.

However, in the case where the water heater described above is incorporated into a circulation type hot water supply system and used, even when any abnormality has not occurred in the water heater, the temperature of the air within the housing may become high. Such a situation occurs when high-temperature water flows from the water supply pipe into the second heat exchanger so that it is not possible to sufficiently cool air flowing from the air supply pipe into the interior of the housing. In such a case, if the water heater is emergently stopped when the temperature detected by the apparatus interior temperature sensor reaches the upper limit temperature, the water heater is emergently stopped even though some kind of abnormality has not occurred in the water heater.

The present specification provides a technique which solves the above-described problem. The present specification provides a technique in which, when abnormality occurs in a water heater incorporated into a circulation type hot water supply system, the water heater is assuredly emergently stopped, but when abnormality has not occurred in the water heater, the water heater is continuously operable.

BRIEF SUMMARY OF INVENTION

The hot water supply system disclosed in the present specification includes: a water heater; a circulating water passage through which water is circulated between the water heater and a hot water supply location; a water supply passage through which water is supplied to the circulating water passage; and a circulating pump provided on the circulating water passage. The water heater includes: a housing; a combustion chamber housed within the housing; a burner housed within the combustion chamber, an air supply fan configured to send air within the housing into an interior of the combustion chamber, a first heat exchanger housed within the combustion chamber and configured to exchange heat between combustion gas from the burner and water flowing therethrough; a water supply pipe which is housed within the housing and through which water is supplied to the first heat exchanger, a hot water supply pipe which is housed within the housing and through which hot water is supplied from the first heat exchanger an air supply pipe through which air is introduced from an outdoor space into an interior of the housing; an exhaust pipe through which exhaust gas is discharged from the interior of the combustion chamber to the outdoor space and at which heat exchange is performed between the air flowing through the air supply pipe and the exhaust gas flowing through the exhaust pipe; a second heat exchanger housed within the housing and configured to exchange heat between the air flowing from the air supply pipe into the interior of the housing and water flowing therethrough; a first bypass pipe which is housed within the housing and through which the water from the water supply pipe is sent to the second heat exchanger, a second bypass pipe which is housed within the housing and through which the water from the second heat exchanger is sent to the hot water supply pipe; an apparatus interior temperature sensor configured to detect a temperature of air within the housing; and a control device housed within the housing. The water heater is configured to emergently stop if the burner is performing combustion, the air supply fan is operating, the circulating pump is not operating, and a temperature detected by the apparatus interior temperature sensor exceeds an upper limit temperature. The water heater is configured to execute an apparatus interior cooling operation of stopping combustion of the burner, driving the air supply fan, and driving the circulating pump, if the burner is performing combustion, the air supply fan is operating, the circulating pump is operating, and the temperature detected by the apparatus interior temperature sensor exceeds the upper limit temperature.

In the above-described hot water supply system, if the temperature detected by the apparatus interior temperature sensor exceeds the upper limit temperature while the circulating pump is operating, it is not determined that abnormality has occurred in the water heater, it is determined that cooling of the air by the second heat exchanger is insufficient, and the apparatus interior cooling operation is executed. In addition, in the above-described hot water supply system, if the temperature detected by the apparatus interior temperature sensor exceeds the upper limit temperature while the circulating pump is not operating, it is determined that some kind of abnormality has occurred in the water heater, and the water heater is emergently stopped. According to the above-described hot water supply system, if abnormality has occurred in the water heater, the water heater can be assuredly emergently stopped; and if abnormality has not occurred in the water heater, the water heater can be continuously operable.

DETAILED DESCRIPTION OF INVENTION

Figure 1:
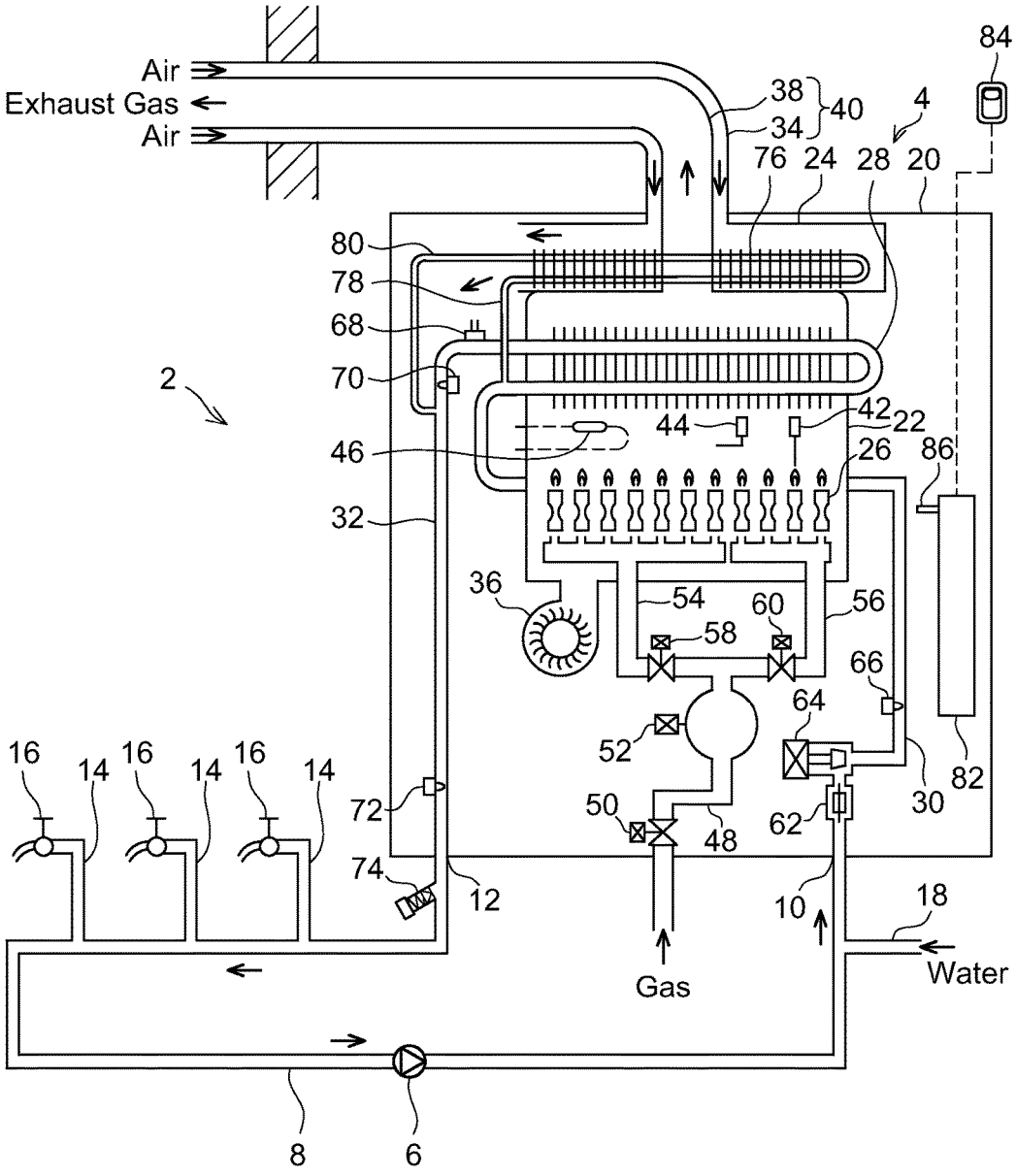
FIG. 1 is a diagram schematically showing the configuration of a hot water supply system 2 according to an embodiment.

In one or more embodiments of the hot water supply system, the water heater may be configured to limit a maximum combustion capacity of the burner if the burner is performing combustion, the air supply fan is operating, and the temperature detected by the apparatus interior temperature sensor exceeds a first switching temperature which is lower than the upper limit temperature.

According to the above-described hot water supply system, if the temperature detected by the apparatus interior temperature sensor increases, it is possible to prevent the temperature of the air within the housing from further increasing, by reducing the combustion capacity of the burner.

In one or more embodiments of the hot water supply system, the water heater may be configured to cancel limitation of the maximum combustion capacity of the burner if the maximum combustion capacity of the burner is limited, the burner is performing combustion, the air supply fan is operating, and the temperature detected by the apparatus interior temperature sensor is lower than a second switching temperature which is lower than the first switching temperature.

According to the above-described hot water supply system, if the temperature of the air within the housing decreases due to reduction of the combustion capacity of the burner, it is possible to return the combustion capacity of the burner to an ordinary capacity.

Representative, non-limiting examples of the present invention will now be described in further detail with reference to the attached drawings. This detailed description is merely intended to teach a person of skill in the art further details for practicing preferred aspects of the present teachings and is not intended to limit the scope of the invention. Furthermore, each of the additional features and teachings disclosed below may be utilized separately or in conjunction with other features and teachings to provide improved hot water supply systems, as well as methods for using and manufacturing the same.

Moreover, combinations of features and steps disclosed in the following detailed description may not be necessary to practice the invention in the broadest sense, and are instead taught merely to particularly describe representative examples of the invention. Furthermore, various features of the above-described and below-described representative examples, as well as the various independent and dependent claims, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

Embodiment

As shown in FIG. 1, a hot water supply system 2 according to the present embodiment is a circulation type hot water supply system which includes a water heater 4 and a circulating pump 6. The water heater 4 and the circulating pump 6 are provided on a circulating water passage 8. The water heater 4 heats water flowing thereinto through a circulating water inlet 10 thereof to a hot water supply set temperature, and sends out the heated water through a circulating water outlet 12 thereof. The circulating pump 6 circulates water through the circulating water passage 8. A plurality of hot water supply passages 14 are connected to the circulating water passage 8. Each hot water supply passage 14 is connected to a hot water tap 16 such as a faucet or a shower. In addition, to the circulating water passage 8, a water supply passage 18 is connected at the downstream side of the plurality of hot water supply passages 14 and at the upstream side of the circulating water inlet 10 of the water heater 4. The water supply passage 18 is connected to a water supply source such as waterworks. When the hot water tap 16 is opened, water at the hot water supply set temperature is supplied from the circulating water passage 8 to the hot water tap 16, and low-temperature water is supplied from the water supply passage 18 to the circulating water passage 8.

The water heater 4 is a forced draft direct vent type (FF type) water heater. The water heater 4 includes a housing 20, a combustion chamber 22 housed within the housing 20, and an air supply chamber 24 housed within the housing 20. A plurality of burners 26 and a first heat exchanger 28 are housed within the combustion chamber 22. To an inlet of the first heat exchanger 28, a water supply pipe 30 which communicates with the circulating water inlet 10 is connected. To an outlet of the first heat exchanger 28, a hot water supply pipe 32 which communicates with the circulating water outlet 12 is connected. Water having flowed into the water heater 4 through the circulating water inlet 10 flows into the first heat exchanger 28 via the water supply pipe 30, and is heated by heat exchange with combustion gas from the burners 26 while passing through the first heat exchanger 28. The water having passed through the first heat exchanger 28 flows out from the water heater 4 through the circulating water outlet 12 via the hot water supply pipe 32.

An air supply pipe 34 through which air is supplied from an outdoor space communicates with the air supply chamber 24. In addition, a portion of the air supply chamber 24 is opened within the housing 20. In the combustion chamber 22, an air supply fan 36 which sucks air from the interior of the housing 20 into the interior of the combustion chamber 22 is provided. In addition, an exhaust pipe 38 through which exhaust gas is discharged to the outdoor space communicates with the combustion chamber 22. In causing the burners 26 to perform combustion, by driving the air supply fan 36, air is supplied from the air supply pipe 34 through the air supply chamber 24 into the interior of the housing 20, and the air within the housing 20 is supplied into the interior of the combustion chamber 22. In addition, the combustion gas from the burners 26 passes through the first heat exchanger 28, and then is discharged through the exhaust pipe 38 to the outdoor space. The air supply pipe 34 and the exhaust pipe 38 form a duplex pipe 40 in which the exhaust pipe 38 is housed within the air supply pipe 34, and counterflow heat exchange is performed between the air flowing through the air supply pipe 34 and the exhaust gas flowing through the exhaust pipe 38. Thus, the exhaust gas flowing through the exhaust pipe 38 is cooled to a low temperature and discharged to the outdoor space, and the air flowing through the air supply pipe 34 is heated to a high temperature and introduced into the air supply chamber 24. With this configuration, it is possible to reduce an environmental load by lowering the temperature of the exhaust gas to be discharged from the exhaust pipe 38, and to preheat the air flowing through the air supply pipe 34 by using heat collected from the exhaust gas.

Within the combustion chamber 22, an ignition electrode 42 for igniting the burners 26, a flame rod 44 for detecting flame of the burners 26, and a temperature fuse 46 for preventing overheating by the burners 26 are provided. Gas which is fuel is supplied to the burners 26 through a gas supply passage 48. On the gas supply passage 48, a main open/close valve 50 and a flow control valve 52 are provided. The main open/close valve 50 switches between conduction and non-conduction of the gas supply passage 48. The flow control valve 52 adjusts the flow rate of the gas flowing through the gas supply passage 48. The gas supply passage 48 branches into a first gas distribution passage 54 through which the gas is supplied to some (e.g., seven burners 26) of the plurality of burners 26; and a second gas distribution passage 56 through which the gas is supplied to the rest (e.g., four burners 26) of the plurality of burners 26. On the first gas distribution passage 54, a first open/close valve 58 which switches between conduction and non-conduction of the first gas distribution passage 54 is provided. On the second gas distribution passage 56, a second open/close valve 60 which switches between conduction and non-conduction of the second gas distribution passage 56 is provided. In the water heater 4, it is possible to change the number of burners 26 caused to perform combustion, by switching open/close states of the first open/close valve 58 and the second open/close valve 60.

On the water supply pipe 30, a flow sensor 62, a servo valve 64, and a first temperature sensor 66 are provided. The flow sensor 62 detects the flow rate of water flowing through the water supply pipe 30. The servo valve 64 adjusts the flow rate of the water flowing through the water supply pipe 30. The first temperature sensor 66 detects the temperature of the water flowing through the water supply pipe 30.

On the hot water supply pipe 32, a bimetal switch 68, a second temperature sensor 70, a third temperature sensor 72, and a relief valve 74 are provided. The bimetal switch 68 is provided near the outlet of the first heat exchanger 28, and operates when the temperature of water flowing out from the first heat exchanger 28 becomes a high temperature which is abnormal. The second temperature sensor 70 is provided near the outlet of the first heat exchanger 28, and detects the temperature of the water flowing from the first heat exchanger 28 into the hot water supply pipe 32. The third temperature sensor 72 is provided near the circulating water outlet 12, and detects the temperature of water flowing out from the hot water supply pipe 32 into the circulating water passage 8. The relief valve 74 is provided near the circulating water outlet 12, and opens when the pressure in the circulating water passage 8 exceeds an upper limit.

A second heat exchanger 76 is housed within the air supply chamber 24. An inlet of the second heat exchanger 76 communicates with the water supply pipe 30 near the inlet of the first heat exchanger 28 through a first bypass pipe 78. An outlet of the second heat exchanger 76 communicates with the hot water supply pipe 32 at the downstream side of the bimetal switch 68 and the second temperature sensor 70 through a second bypass pipe 80. At the second heat exchanger 76, heat is exchanged between the water from the water supply pipe 30 and the air from the air supply pipe 34. The water subjected to the heat exchange at the second heat exchanger 76 is sent out to the hot water supply pipe 32. When the temperature of the air flowing from the air supply pipe 34 into the air supply chamber 24 is high, the air is cooled by the heat exchange at the second heat exchanger 76, and then flows into the interior of the housing 20. Thus, it is possible to prevent the temperature of the interior of the housing 20 from being excessively high.

The control device 82 is housed within the housing 20. The control device 82 controls operation of the circulating pump 6 and each component within the water heater 4. The control device 82 is able to communicate with a remote controller 84. A user of the hot water supply system 2 confirms an operating state of the hot water supply system 2 via the remote controller 84, and also controls operation of the hot water supply system 2 via the remote controller 84. The user of the hot water supply system 2 can set the hot water supply set temperature via the remote controller 84. The control device 82 is provided with an apparatus interior temperature sensor 86. The apparatus interior temperature sensor 86 detects the temperature of the air within the housing 20.

Hereinafter, operation of the hot water supply system 2 will be described with reference to flowcharts of FIGS. 2 to 5. The control device 82 performs a process shown in FIG. 2.

In step S2, the control device 82 waits until start of operation of the hot water supply system 2 is instructed by the user via the remote controller 84. When start of operation of the hot water supply system 2 is instructed (YES in step S2), the process proceeds to step S4.

In step S4, the control device 82 sets an operation mode of the hot water supply system 2 to a normal operation.

In step S6, the control device 82 determines whether the current operation mode of the hot water supply system 2 is an apparatus interior cooling operation. If the current operation mode is not the apparatus interior cooling operation (No in step S6), the process proceeds to step S8.

In step S8, the control device 82 determines whether the temperature of the air within the housing 20 of the water heater 4 has been high. In the present embodiment, the control device 82 determines that the temperature of the air within the housing 20 has been high, if a state where a value detected by the apparatus interior temperature sensor 86 exceeds an apparatus interior upper limit temperature (e.g., 79° C.) has continued for a predetermined time period (e.g., 3 sec.). If the temperature of the air within the housing 20 has not been high (NO in step S8), the process proceeds to step S10.

In step S10, the control device 82 determines whether the current operation mode of the hot water supply system 2 is a capacity reduction operation. If the current operation mode is not the capacity reduction operation (NO in step S10), the process proceeds to step S12.

In step S12, the control device 82 determines whether the temperature detected by the apparatus interior temperature sensor 86 exceeds a first switching temperature (e.g., 75° C.). The first switching temperature is a temperature lower than the apparatus interior upper limit temperature which is used for the determination in step S8. If the temperature detected by the apparatus interior temperature sensor 86 is equal to or lower than the first switching temperature (NO in step S12), the process proceeds to step S14. In step S14, the control device 82 sets the operation mode of the hot water supply system 2 to the normal operation. After step S14, the process proceeds to step S28. If the temperature detected by the apparatus interior temperature sensor 86 exceeds the first switching temperature (YES) in step S12, the process proceeds to step S16. In step S16, the control device 82 sets the operation mode of the hot water supply system 2 to the capacity reduction operation. After step S16, the process proceeds to step S28.

If the current operation mode is the capacity reduction operation (YES) in step S10, the process proceeds to step S18. In step S18, the control device 82 determines whether the temperature detected by the apparatus interior temperature sensor 86 is lower than a second switching temperature (e.g., 70° C.). The second switching temperature is a temperature lower than the first switching temperature which is used for the determination in step S12. If the temperature detected by the apparatus interior temperature sensor 86 is lower than the second switching temperature (YES in step S18), the process proceeds to step S14 in which the control device 82 sets the operation mode of the hot water supply system 2 to the normal operation. If the temperature detected by the apparatus interior temperature sensor 86 is equal to or higher than the second switching temperature (NO) in step S18, the process proceeds to step S16 in which the control device 82 sets the operation mode of the hot water supply system 2 to the capacity reduction operation.

If the temperature of the air within the housing 20 has been high (YES) in step S8, the process proceeds to step S20. In step S20, the control device 82 determines whether the circulating pump 6 is being driven. If the circulating pump 6 is not being driven (NO in step S20), the process proceeds to step S22. In step S22, the control device 82 performs an emergency stop process of emergently stopping the hot water supply system 2, and ends the process in FIG. 2. In the emergency stop process, the control device 82 closes the main open/close valve 50 to extinguish the burners 26, and also performs a post purge operation with the air supply fan 36, then stops the air supply fan 36, and stops the circulating pump 6. In addition, the control device 82 notifies the user that the emergency stop has been performed, via the remote controller 84. If the circulating pump 6 is being driven (YES) in step S20, the process proceeds to step S24 in which the control device 82 sets the operation mode of the hot water supply system 2 to the apparatus interior cooling operation. After step S24, the process proceeds to step S28.

If the current operation mode is the apparatus interior cooling operation in step S6 (YES in step S6), the process proceeds to step S26. In step S26, the control device 82 determines whether the temperature detected by the apparatus interior temperature sensor 86 is lower than a third switching temperature (e.g., 60C). The third switching temperature is a temperature lower than the apparatus interior upper limit temperature which is used for the determination in step S8. If the temperature detected by the apparatus interior temperature sensor 86 is equal to or higher than the third switching temperature (NO in step S26), the process proceeds to step S24 in which the control device 82 sets the operation mode of the hot water supply system 2 to the apparatus interior cooling operation. If the temperature detected by the apparatus interior temperature sensor 86 is lower than the third switching temperature in step S26 (YES in step S26), the process proceeds to step S14 in which the control device 82 sets the operation mode of the hot water supply system 2 to the normal operation.

In steps S28, S30, and S32, the control device 82 performs combustion control of the burners 26, driving control of the air supply fan 36, and driving control of the circulating pump 6, respectively, in accordance with the operation mode of the hot water supply system 2. These controls will be described in detail later.

In step S34, the control device 82 determines whether stop of operation of the hot water supply system 2 has been instructed by the user via the remote controller 84. If stop of operation of the hot water supply system 2 has not been instructed (NO in step S34), the process returns to step S6. If stop of operation of the hot water supply system 2 has been instructed (YES) in step S34, the process proceeds to step S36 in which the control device 82 performs a normal stop process. In the normal stop process, the control device 82 closes the main open/close valve 50 to extinguish the burners 26, and also performs the post purge operation with the air supply fan 36, then stops the air supply fan 36, and stops the circulating pump 6. After step S36, the process returns to step S2.

Figure 2:
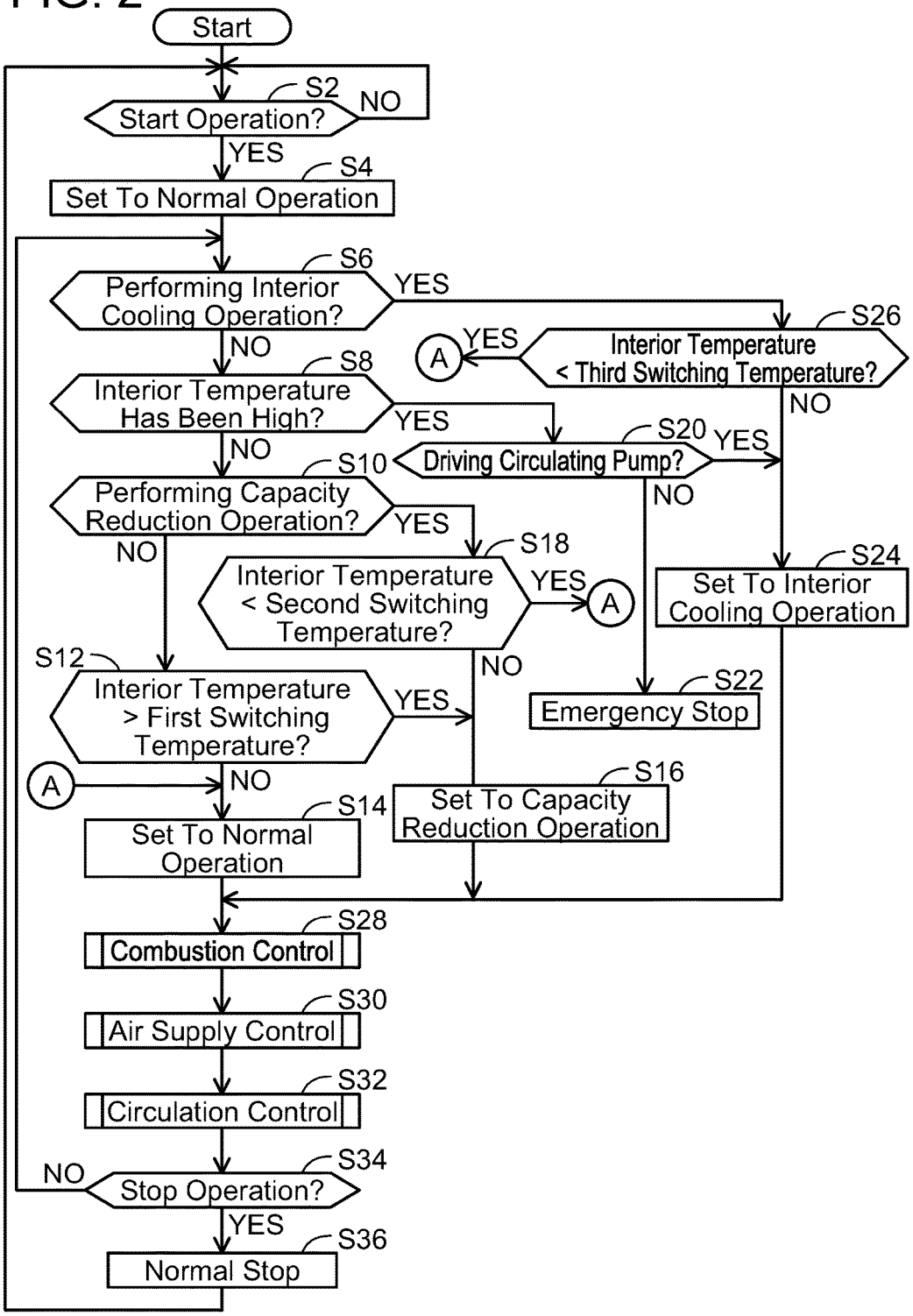
FIG. 2 is a flowchart illustrating a process performed by a control device 82 of the hot water supply system 2 according to the embodiment.
Figure 3:
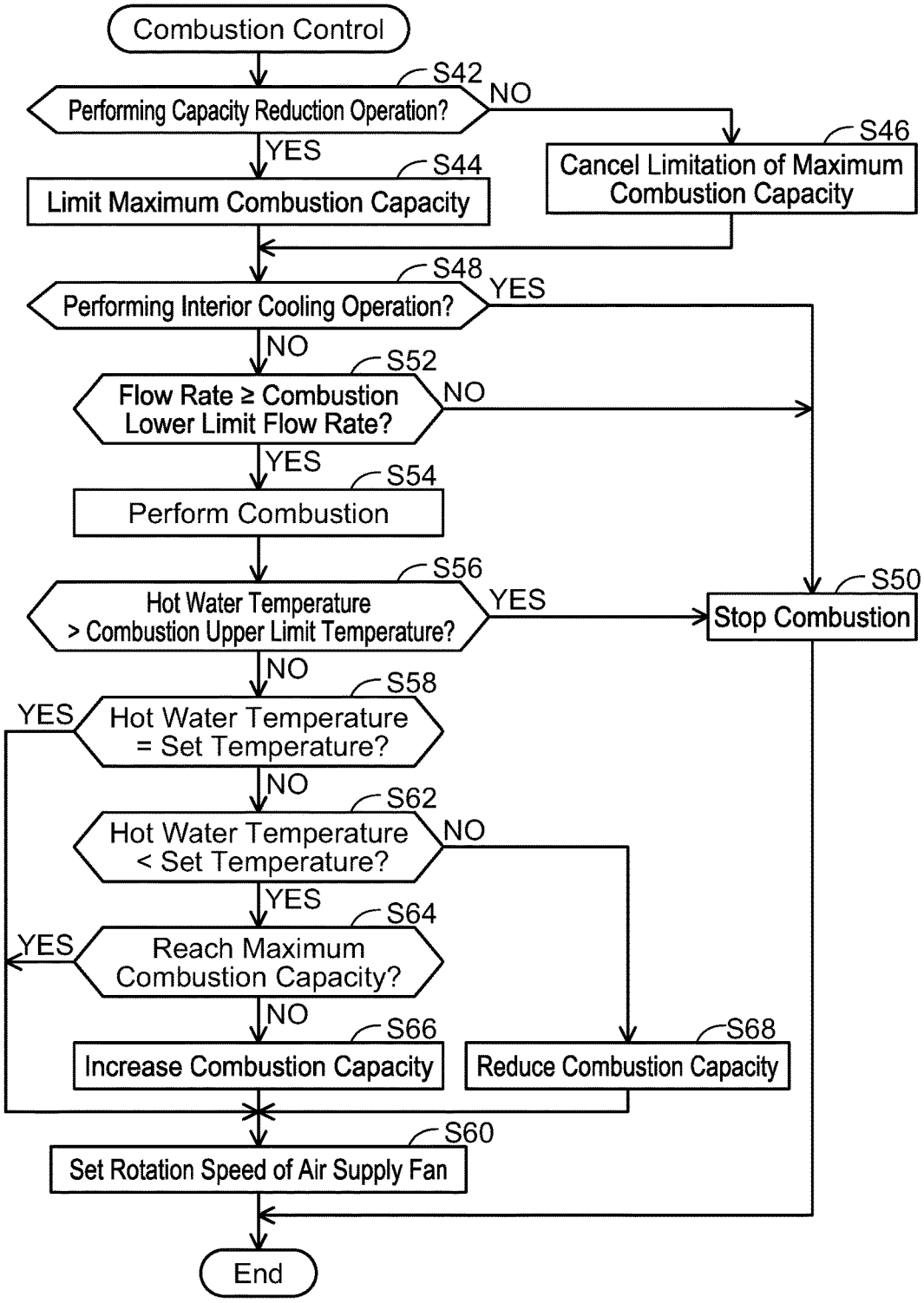
FIG. 3 is a flowchart illustrating a combustion control process performed by the control device 82 of the hot water supply system 2 according to the embodiment.

FIG. 3 is a flowchart showing the details of the combustion control of the burners 26 performed in step S28 in FIG. 2. In step S42, the control device 82 determines whether the current operation mode of the hot water supply system 2 is the capacity reduction operation. If the current operation mode is the capacity reduction operation (YES in step S42), the process proceeds to step S44 in which the control device 82 limits a maximum combustion capacity. After step S44, the process proceeds to step S48. If the current operation mode is not the capacity reduction operation (NO in step S42), the process proceeds to step S46. If the maximum combustion capacity is limited, the control device 82 cancels the limitation. After step S46, the process proceeds to step S48.

In step 348, the control device 82 determines whether the current operation mode of the hot water supply system 2 is the apparatus interior cooling operation. If the current operation mode is the apparatus interior cooling operation (YES in step S48), the process proceeds to step 350. In step S50, the control device 82 closes the main open/close valve 50 to stop combustion of the burners 26, and ends the process in FIG. 3.

If the current operation mode is not the apparatus interior cooling operation (NO in step S48), the process proceeds to step S52. In step S52, the control device 82 determines whether the flow rate detected by the flow sensor 62 is equal to or higher than a combustion lower limit flow rate (e.g., 0.5 L/min). If the flow rate detected by the flow sensor 62 is lower than the combustion lower limit flow rate (NO in step S52), the process proceeds to step S50 in which the control device 82 stops combustion of the burners 26. If the flow rate detected by the flow sensor 62 is equal to or higher than the combustion lower limit flow rate (YES in step S52), the process proceeds to step S54.

In step S54, the control device 82 opens the main open/close valve 50 and ignites the burners 26 with the ignition electrode 42 to cause the burners 26 to perform combustion.

In step S56, the control device 82 determines whether the temperature detected by the third temperature sensor 72 exceeds a combustion upper limit temperature. In the present embodiment, the combustion upper limit temperature is a temperature obtained by adding a predetermined temperature width (e.g., 3° C.) to the hot water supply set temperature which is set by the remote controller 84. If the temperature detected by the third temperature sensor 72 exceeds the combustion upper limit temperature (YES in step S56), the process proceeds to step S50 in which the control device 82 stops combustion of the burners 26. If the temperature detected by the third temperature sensor 72 is equal to or lower than the combustion upper limit temperature (NO in step S56), the process proceeds to step S58.

In step S58, the control device 82 determines whether the temperature detected by the third temperature sensor 72 is equal to the hot water supply set temperature. If the temperature detected by the third temperature sensor 72 is equal to the hot water supply set temperature (YES in step S58), the process proceeds to step S60. In step S60, the control device 82 sets a rotation speed of the air supply fan 36 to a rotation speed corresponding to the current combustion capacity of the burners 26, and ends the process in FIG. 3.

If the temperature detected by the third temperature sensor 72 is different from the hot water supply set temperature (NO) in step S58, the process proceeds to step S62. In step S62, the control device 82 determines whether the temperature detected by the third temperature sensor 72 is lower than the hot water supply set temperature. If the temperature detected by the third temperature sensor 72 is lower than the hot water supply set temperature (YES in step S62), the process proceeds to step S64.

In step S64, the control device 82 determines whether the current combustion capacity of the burners 26 has reached the maximum combustion capacity. If the current combustion capacity has reached the maximum combustion capacity (YES in step S64), the process proceeds to step S60. If the current combustion capacity has not reached the maximum combustion capacity (NO in step S64), the process proceeds to step S66. In step S66, the control device 82 increases the combustion capacity of the burners 26 by switching the open/close states of the first open/close valve 58 and the second open/close valve 60 and adjusting the opening degree of the flow control valve 52. After step S66, the process proceeds to step S60.

If the temperature detected by the third temperature sensor 72 exceeds the hot water supply set temperature in step S62 (NO in step S62), the process proceeds to step S68. In step S68, the control device 82 reduces the combustion capacity of the burners 26 by switching the open/close states of the first open/close valve 58 and the second open/close valve 60 and adjusting the opening degree of the flow control valve 52. After step S68, the process proceeds to step S60.

Figure 4:
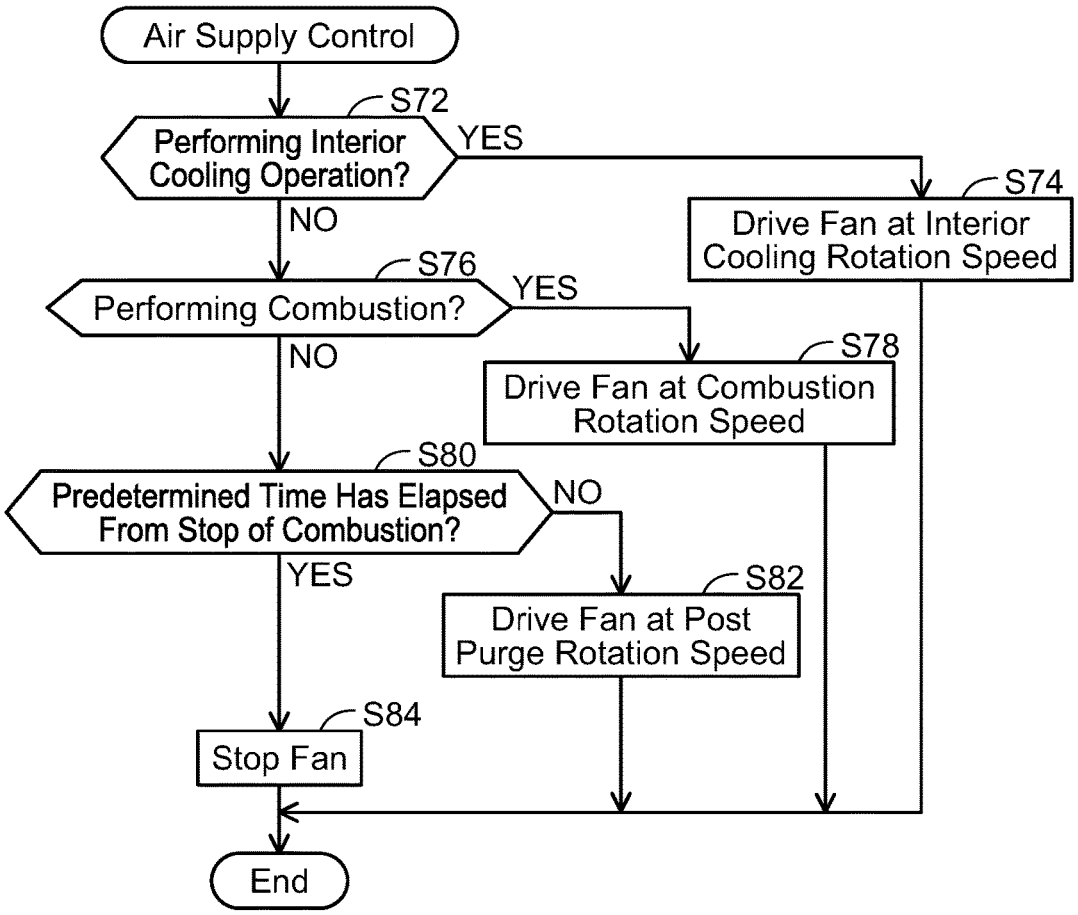
FIG. 4 is a flowchart illustrating an air supply control process performed by the control device 82 of the hot water supply system 2 according to the embodiment.

FIG. 4 is a flowchart showing the details of the driving control of the air supply fan 36 performed in step S32 in FIG. 2. In step S72, the control device 82 determines whether the current operation mode of the hot water supply system 2 is the apparatus interior cooling operation. If the current operation mode is the apparatus interior cooling operation (YES in step S72), the process proceeds to step S74. In step S74, the control device 82 drives the air supply fan 36 at a rotation speed (also referred to as apparatus interior cooling rotation speed) preset as a fan rotation speed in the apparatus interior cooling operation, and ends the process in FIG. 4.

If the current operation mode is not the apparatus interior cooling operation (NO) in step S72, the process proceeds to step S76. In step S76, the control device 82 determines whether the burners 26 are performing combustion. If the burners 26 are performing combustion (YES in step S76), the process proceeds to step S78. In step S78, the control device 82 drives the air supply fan 36 at a rotation speed (also referred to as combustion rotation speed) instructed in the combustion control in FIG. 3, and ends the process in FIG. 4.

If the burners 26 are not performing combustion (NO) in step S76, the process proceeds to step S80. In step S80, the control device 82 determines whether a predetermined time (e.g., 5 minutes) has elapsed from stop of the combustion of the burners 26. If the predetermined time has not elapsed from the stop of the combustion of the burners 26 (No in step S80), the process proceeds to step S82. In step S82, the control device 82 drives the air supply fan 36 at a rotation speed (also referred to as post purge rotation speed) preset as a fan rotation speed in the post purge operation, and ends the process in FIG. 4.

If the predetermined time has elapsed from the stop of the combustion of the burners 26 in step S80 (YES in step S80), the process proceeds to step S84. In step S84, the control device 82 stops the air supply fan 36 and ends the process in FIG. 4.

Figure 5:
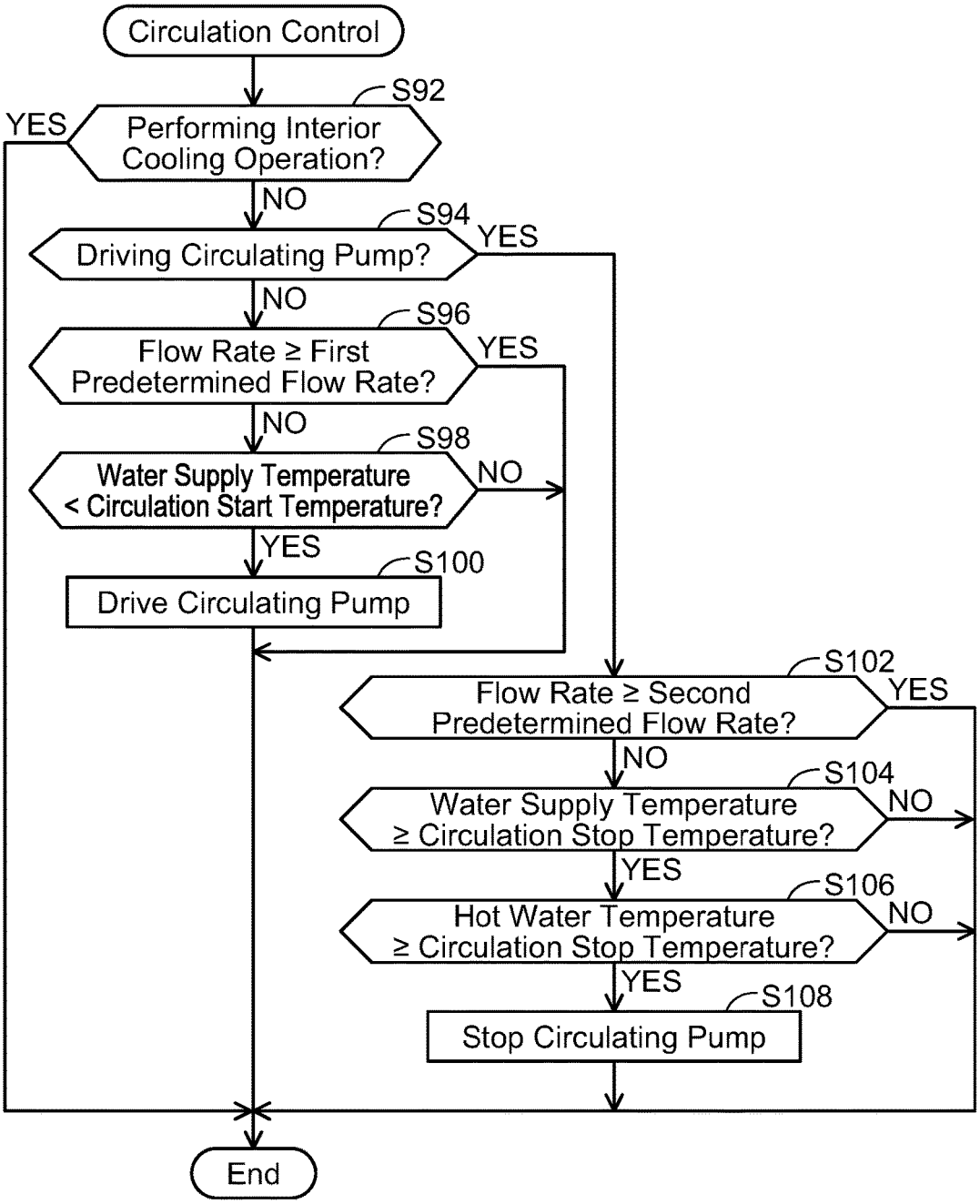
FIG. 5 is a flowchart illustrating a circulation control process performed by the control device 82 of the hot water supply system 2 according to the embodiment.

FIG. 5 is a flowchart showing the details of the driving control of the circulating pump 6 performed in step S30 in FIG. 2. In step S92, the control device 82 determines whether the current operation mode of the hot water supply system 2 is the apparatus interior cooling operation. In the apparatus interior cooling operation, the circulating pump 6 is already operating. If the current operation mode is the apparatus interior cooling operation (YES in step S92), the control device 82 ends the process in FIG. 5 without stopping the circulating pump 6. If the current operation mode is not the apparatus interior cooling operation (NO in step S92), the process proceeds to step S94.

In step S94, the control device 82 determines whether the circulating pump 6 is operating. If the circulating pump 6 is not operating (NO in step S94), the process proceeds to step S96.

In step S96, the control device 82 determines whether the flow rate detected by the flow sensor 62 is equal to or higher than a first predetermined flow rate. In the present embodiment, the first predetermined flow rate is a minimum flow rate (e.g., 0.5 L/min.) which should be detected by the flow sensor 62 when any hot water tap 16 is opened in a state where the circulating pump 6 is not operating. If the flow rate detected by the flow sensor 62 is equal to or higher than the first predetermined flow rate (YES in step S96), this means that hot water is supplied to the hot water tap 16 in a state where the circulating pump 6 is not operating, that is, in a state where the interior of the circulating water passage 8 is filled with water at the hot water supply set temperature. In this case, the control device 82 ends the process in FIG. 5 without driving the circulating pump 6.

In step S98, the control device 82 determines whether the temperature detected by the first temperature sensor 66 is lower than a circulation start temperature. In the present embodiment, the circulation start temperature is a temperature obtained by subtracting a predetermined temperature width (e.g., 2° C.) from the hot water supply set temperature. If the temperature detected by the first temperature sensor 66 is equal to or higher than the circulation start temperature (NO in step S98), the control device 82 ends the process in FIG. 5 without driving the circulating pump 6. If the temperature detected by the first temperature sensor 66 is lower than the circulation start temperature (YES in step S98), this means that the temperature of the water within the circulating water passage 8 has been decreased to a temperature lower than the hot water supply set temperature to some extent, due to natural heat radiation. In such a case, the process proceeds to step S100. In step S100, the control device 82 drives the circulating pump 6 and ends the process in FIG. 5.

If the circulating pump 6 is operating in step S94 (YES in step S94), the process proceeds to step S102. In step S102, the control device 82 determines whether the flow rate detected by the flow sensor 62 is equal to or higher than a second predetermined flow rate. In the present embodiment, the second predetermined flow rate is a minimum flow rate (e.g., 6 L/min.) which should be detected by the flow sensor 62 when any hot water tap 16 is opened in a state where the circulating pump 6 is operating. If the flow rate detected by the flow sensor 62 is equal to or higher than the second predetermined flow rate (YES in step S102), this means that hot water is supplied to the hot water tap 16 in a state where the circulating pump 6 is operating, that is, in a state where the water within the circulating water passage 8 is circulated and heated to the hot water supply set temperature. In this case, the control device 82 ends the process in FIG. 5 without stopping the circulating pump 6.

If the flow rate detected by the flow sensor 62 is lower than the second predetermined flow rate (NO) in step S102, the process proceeds to step S104. In step S104, the control device 82 determines whether the temperature detected by the first temperature sensor 66 is equal to or higher than a circulation stop temperature. In the present embodiment, the circulation stop temperature is a temperature obtained by subtracting a predetermined temperature width (e.g., 1° C.) from the hot water supply set temperature. If the temperature detected by the first temperature sensor 66 is lower than the circulation stop temperature (NO in step S104), the control device 82 ends the process in FIG. 5 without stopping the circulating pump 6. If the temperature detected by the first temperature sensor 66 is equal to or higher than the circulation stop temperature (YES in step S104), the process proceeds to step S106.

In step S106, the control device 82 determines whether the temperature detected by the third temperature sensor 72 is equal to or higher than the circulation stop temperature. If the temperature detected by the third temperature sensor 72 is lower than the circulation stop temperature (NO in step S106), the control device 82 ends the process in FIG. 5 without stopping the circulating pump 6. If the temperature detected by the third temperature sensor 72 is equal to or higher than the circulation stop temperature (YES in step S106), the process proceeds to step S108.

In step S108, the control device 82 stops the circulating pump 6 and ends the process in FIG. 5.

As described above, the hot water supply system 2 according to the present embodiment includes the water heater 4, the circulating water passage 8 through which water is circulated between the water heater 4 and each hot water supply passage 14 (corresponding to a hot water supply location), the water supply passage 18 through which water is supplied to the circulating water passage 8, and the circulating pump 6 provided on the circulating water passage 8. The water heater 4 includes: the housing 20; the combustion chamber 22 which is housed within the housing 20; the burners 26 which are housed within the combustion chamber 22; the air supply fan 36 which sends the air within the housing 20 into the interior of the combustion chamber 22; the first heat exchanger 28 which is housed within the combustion chamber 22 and exchanges heat between the combustion gas from the burners 26 and the water flowing therethrough; the water supply pipe 30 which is housed within the housing 20 and through which water is supplied to the first heat exchanger 28; the hot water supply pipe 32 which is housed within the housing 20 and through which hot water is supplied from the first heat exchanger 28; the air supply pipe 34 through which air is introduced from the outdoor space into the interior of the housing 20; the exhaust pipe 38 through which the exhaust gas is discharged from the interior of the combustion chamber 22 to the outdoor space and at which heat exchange is performed between the air flowing through the air supply pipe 34 and the exhaust gas flowing through the exhaust pipe 38; the second heat exchanger 76 which is housed within the housing 20 and exchanges heat between the air flowing from the air supply pipe 34 into the interior of the housing 20 and water flowing therethrough; the first bypass pipe 78 which is housed within the housing 20 and through which the water from the water supply pipe 30 is sent to the second heat exchanger 76; the second bypass pipe 80 which is housed within the housing 20 and through which water from the second heat exchanger 76 is sent to the hot water supply pipe 32; the apparatus interior temperature sensor 86 which detects the temperature of the air within the housing 20; and the control device 82 which is housed within the housing 20.

As shown in steps S8, S20, and S22 in FIG. 2 and FIGS. 3 to 5, the water heater 4 is configured to emergently stop if the burners 26 are performing combustion, the air supply fan 36 is operating, the circulating pump 6 is not operating, and the temperature detected by the apparatus interior temperature sensor 86 exceeds the upper limit temperature. In addition, as shown in steps S8, S20, and S24 in FIG. 2 and FIGS. 3 to 5, the water heater 4 is configured to execute the apparatus interior cooling operation of stopping combustion of the burners 26, driving the air supply fan 36, and driving the circulating pump 6, if the burners 26 are performing combustion, the air supply fan 36 is operating, the circulating pump 6 is operating, and the temperature detected by the apparatus interior temperature sensor 86 exceeds the upper limit temperature.

As shown in steps S12 and S6 in FIG. 2, steps S42 and S44 in FIG. 3, and FIG. 4, the water heater 4 is configured to limit the maximum combustion capacity of the burners 26 if the burners 26 are performing combustion, the air supply fan 36 is operating, and the temperature detected by the apparatus interior temperature sensor 86 exceeds the first switching temperature which is lower than the upper limit temperature.

As shown in steps S10, S18, and S14 in FIG. 2, steps S42 and S46 in FIG. 3, and FIG. 4, the water heater 4 is configured to cancel limitation of the maximum combustion capacity of the burners 26 if the maximum combustion capacity of the burners 26 is limited, the burners 26 are performing combustion, the air supply fan 36 is operating, and the temperature detected by the apparatus interior temperature sensor 86 is lower than the second switching temperature which is lower than the first switching temperature.

Specific examples of the present invention has been described in detail, however, these are mere exemplary indications and thus do not limit the scope of the claims. The art described in the claims include modifications and variations of the specific examples presented above. Technical features described in the description and the drawings may technically be useful alone or in various combinations, and are not limited to the combinations as originally claimed. Further, the art described in the description and the drawings may concurrently achieve a plurality of aims, and technical significance thereof resides in achieving any one of such aims.

What is claimed is:

1. A hot water supply system comprising:

a water heater;

a circulating water passage through which water is circulated between the water heater and a hot water supply location;

a water supply passage through which water is supplied to the circulating water passage; and a circulating pump provided on the circulating water passage, wherein the water heater includes:

a housing;

a combustion chamber housed within the housing;

a burner housed within the combustion chamber;

an air supply fan configured to send air within the housing into an interior of the combustion chamber;

a first heat exchanger housed within the combustion chamber and configured to exchange heat between combustion gas from the burner and water flowing therethrough;

a water supply pipe which is housed within the housing and through which water is supplied to the first heat exchanger;

a hot water supply pipe which is housed within the housing and through which hot water is supplied from the first heat exchanger;

an air supply pipe through which air is introduced from an outdoor space into an interior of the housing;

an exhaust pipe through which exhaust gas is discharged from the interior of the combustion chamber to the outdoor space and at which heat exchange is performed between the air flowing through the air supply pipe and the exhaust gas flowing through the exhaust pipe;

a second heat exchanger housed within the housing and configured to exchange heat between the air flowing from the air supply pipe into the interior of the housing and water flowing therethrough;

a first bypass pipe which is housed within the housing and through which the water from the water supply pipe is sent to the second heat exchanger;

a second bypass pipe which is housed within the housing and through which the water from the second heat exchanger is sent to the hot water supply pipe;

an apparatus interior temperature sensor configured to detect a temperature of air within the housing; and a control device housed within the housing, the water heater is configured to emergently stop if the burner is performing combustion, the air supply fan is operating, the circulating pump is not operating, and a temperature detected by the apparatus interior temperature sensor exceeds an upper limit temperature, and the water heater is configured to execute an apparatus interior cooling operation of stopping combustion of the burner, driving the air supply fan, and driving the circulating pump, if the burner is performing combustion, the air supply fan is operating, the circulating pump is operating, and the temperature detected by the apparatus interior temperature sensor exceeds the upper limit temperature.

2. The hot water supply system according to claim 1, wherein the water heater is configured to limit a maximum combustion capacity of the burner if the burner is performing combustion, the air supply fan is operating, and the temperature detected by the apparatus interior temperature sensor exceeds a first switching temperature which is lower than the upper limit temperature.

3. The hot water supply system according to claim 2, wherein the water heater is configured to cancel limitation of the maximum combustion capacity of the burner if the maximum combustion capacity of the burner is limited, the burner is performing combustion, the air supply fan is operating, and the temperature detected by the apparatus interior temperature sensor is lower than a second switching temperature which is lower than the first switching temperature.

* * * * *